United States Patent [19]

Sproul et al.

[11] Patent Number: 4,813,481

[45] Date of Patent: Mar. 21, 1989

[54] EXPENDABLE FLAPPER VALVE

[75] Inventors: Richard M. Sproul, Grapevine; Frank Giusti, Jr., Lewisville, both of Tex.; Richard L. Grant, Riveridge; Kennedy J. Brown, Belle Chasse, both of La.

[73] Assignee: Otis Engineering Corporation, Dallas, Tex.

[21] Appl. No.: 89,979

[22] Filed: Aug. 27, 1987

[51] Int. Cl.[4] ..... E21B 43/04; E21B 34/06; F16K 15/14

[52] U.S. Cl. ..... 166/51; 166/317; 166/325; 137/527.8; 251/338; 251/368

[58] Field of Search ..... 166/51, 316–318, 166/325, 326, 332; 137/527, 527.8; 251/294, 303, 336–338, 368

[56] References Cited

U.S. PATENT DOCUMENTS

| | | | |
|---|---|---|---|
| 1,829,666 | 10/1931 | Minster | 166/325 |
| 2,751,021 | 6/1956 | Muse | 166/225 |
| 2,998,077 | 8/1961 | Keithahn | 166/226 |
| 3,032,050 | 5/1962 | Clark | 137/68 |
| 3,292,653 | 12/1966 | Scaramucci | 137/527.8 |
| 3,295,547 | 1/1967 | Scaramucci | 137/527.8 |
| 3,613,720 | 10/1971 | Welch | 137/527.8 |
| 4,103,744 | 8/1978 | Akkerman | 166/324 |
| 4,274,436 | 6/1981 | Smith | 137/527 X |
| 4,378,847 | 4/1983 | Patel et al. | 166/317 |
| 4,423,773 | 1/1984 | Stout | 166/51 |
| 4,457,376 | 7/1984 | Carmody et al. | 166/332 |
| 4,541,484 | 9/1985 | Salerni et al. | 166/325 X |
| 4,541,486 | 9/1985 | Wetzel et al. | 166/51 X |
| 4,691,775 | 9/1987 | Lustig et al. | 166/317 |

*Primary Examiner*—Bruce M. Kisliuk
*Attorney, Agent, or Firm*—Dennis T. Griggs

[57] ABSTRACT

A flapper valve assembly includes a frangible valve closure member which is supported by an elastomeric hinge. The frangible valve closure member is a tempered glass plate, and the hinge is a block of elastomer material which is secured to the glass plate by a molecular bond. In one embodiment, the hinge includes an integrally formed elastomeric jacket which partially encapsulates the glass sealing element and is bonded thereto. In one arrangement, a fluid seal is provided by a resilient, elastomeric seal which is received within a valve pocket, and which is engaged directly by the glass plate. In another arrangement, an annular valve seat is formed in a valve housing sub, with the fluid seal being provided by the elastomeric jacket which is fitted about the glass closure plate.

11 Claims, 8 Drawing Sheets

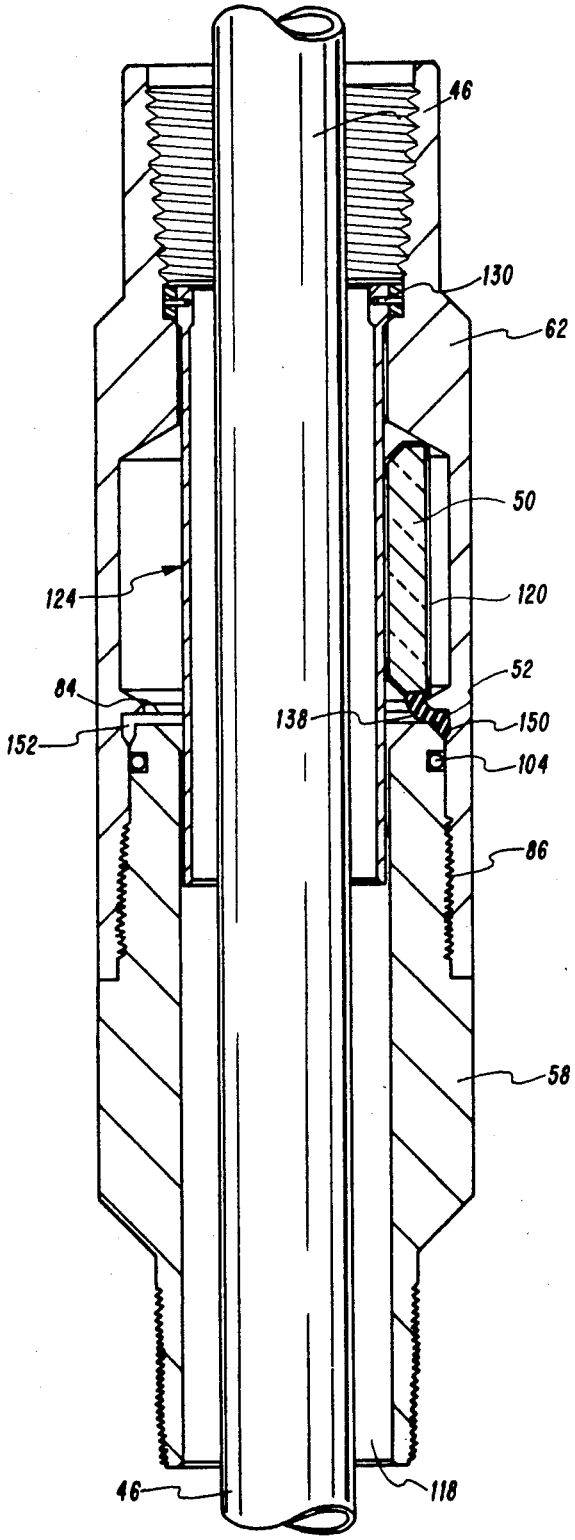
FIG. 15
FIG. 16
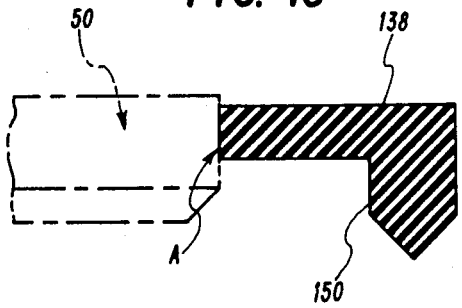

EXPENDABLE FLAPPER VALVE

FIELD OF THE INVENTION

This invention relates generally to petroleum production equipment, and in particular to a formation protection valve which prevents the loss of completion fluid after a gravel packing operation has been completed.

BACKGROUND OF THE INVENTION

In a gravel pack operation, a service seal unit mounted on work string is reciprocated relative to certain flow ports and sealing points within a packer bore to route service fluid along various passages. The service seal unit carries vertical and lateral circulation passages which, when aligned with ports formed in a packer unit, permit service fluid such as acids, polymers, cements, sand or gravel laden liquids to be injected into a formation through the bore of the work string and into the outer annulus between a sand screen and the perforated well casing, thereby avoiding plugging or otherwise damaging the sand screen.

In one position of the service seal unit, the annulus below the packer is sealed and the lateral flow passages of the service seal unit are positioned for discharge directly into the annulus between the work string and the well casing, thereby permitting reverse flow of clean-out fluids upwardly through the bore of the work string. After the gravel packing or other treatment is finished, completion fluids are introduced into the annulus to displace the service fluids used during well treatment. After the completion fluid has been introduced, the service seal unit and the associated wash tube are removed from the well.

Because of the high value of the completion fluid, it is desirable to recover the completion fluid for use during subsequent operations. Additionally, it is desirable to control the effect of completion fluid pressure on the surrounding formation.

DESCRIPTION OF THE PRIOR ART

One method for controlling the effect of completion fluid pressure on the surrounding formation during a gravel pack operation is to spot a gel material in the bore through the liner as the wash pipe is withdrawn to close the liner to fluid flow and protect the formation from the pressure of completion fluid while the handling string is being pulled from the well and the production string is thereafter inserted.

Another method for protecting the adjoining production formation from penetration by completion fluids and the like is an automatically operating flapper valve. Conventional flapper valves are mounted onto the liner for pivotal movement from an upright, open bore position, to a horizontal, closed bore position. The flapper valve is confined in the upright orientation between the wash pipe and the inner bore of the liner during run-in and gravel packing operations. Some flapper valves are biased by a spring so that upon removal of the gravel packing apparatus from the well, the flapper valve is moved into sealing engagement against a valve seat.

When the producing formation is protected by the closed flapper valve, the desired completion operations may be carried out with the wash pipe disengaged, such as cleaning up the well bore. The handling string is then retrieved from the well and a production tubing string is run into the well in its place. The completion and clean up operations may take several days, during which time the formation is protected by the closed valve.

When the production string has been landed and sealed against the upper packer, the flapper valve then must be opened to permit production operations. This has been done by constructing the valve so that it will be ruptured or otherwise destroyed, such as by utilizing a frangible valve member of ceramic or of metal which will rupture under an opening force to provide a full opened bore through the production string. In some cases, the production string is provided with a tail pipe tool which effects destruction or opening of the valve member.

The moveable sealing element of such flapper valves has been constructed of metal or of high strength ceramic material designed to rupture under hydraulic pressure or in response to a downward penetrating force exerted by a tail pipe tool, a wire line tool, or a drop bar. A limiting factor on the use of conventional frangible flapper valves is that the valve sealing element, when constructed sufficiently strong to withhold the required pressure, tends to shatter into large pieces. It is preferable that the frangible sealing element shatter into relatively small pieces which can be removed from the tubing by reverse flow of completion fluid.

Ceramic valve sealing disks have tended to fracture into pieces which are too large to circulate to the surface. Metal valve components, including the hinge assemblies, tend to rupture or fold into large pieces which become lodged within the tubing and interfere with movement and/or operation of tools and accessories within the tubing string, and in some cases, cause scarring and other physical damage to the equipment. The metal hinge structures are securely mounted adjacent to the valve pocket with the result that a considerable part of the hinge structure may remain within the valve pocket, even if most of the valve sealing element has been successfully fractured. As a result, thorough fracture and clear passage in conventional formation protection valve assemblies have been difficult to achieve.

OBJECTS OF THE INVENTION

It is, therefore, an object of the invention to provide an improved formation protection valve assembly which is automatically closeable upon withdrawal of the wash string from the well, and having a frangible sealing element which produces a reliable seal when closed.

A related object of the invention is to provide an improved formation protection valve having a sealing element made of a frangible material which, in response to hydraulic pressure or mechanical impact of a tool, will break into pieces small enough to be circulated out of the well by completion fluid.

Yet another object of the invention is to provide an improved hinge assembly for supporting a frangible valve closure element in a formation protection valve wherein the frangible sealing element can be broken away or otherwise cleanly separated from the hinge assembly to provide a clear passage in response to a rupturing force imparted by hydraulic or mechanical means directed onto the frangible sealing member.

Still another object of the invention is to provide a reliable hinge assembly for supporting a frangible sealing element in a formation protection valve assembly, in which the hinge assembly itself is constructed of an elastomeric material which can be easily stripped or sheared apart in response to a rupturing force applied to the frangible valve closure element.

A related object of the invention is to provide formation protection valve apparatus of the character set forth having an improved valve seating arrangement, which will provide a reliable seal under downhole well conditions when engaged by a flapper valve closure element.

SUMMARY OF THE INVENTION

The foregoing objects are achieved by the present invention in which a flapper valve assembly includes a frangible valve closure member which is supported by an elastomeric hinge. In a first preferred embodiment, the frangible valve closure member is a glass plate, and the hinge is a block of elastomer material which is bonded to the glass closure member. In a second embodiment, the hinge includes an elastomer hinge block and an integrally formed elastomeric jacket which is fitted about the glass sealing element and bonded thereto.

In one valve mounting arrangement, a cylindrical valve seat is confined between a valve seat sub and a valve housing sub. The valve seat is formed in a block having a bore for fluid passage and a tapered counter bore defining a valve pocket, in which a resilient annular seal is retained. The valve block is captured by a radially projecting, annular shoulder disposed within the bore of the valve housing sub. The elastomeric hinge is confined within a hinge slot formed in a cylindrical side wall portion of the valve seat. The elastomeric hinge is pivotally coupled to the valve seat by a hinge pin, which permits the sealing element to move into and out of the valve pocket. A resilient, elastomeric annular seal is received within the valve pocket, and provides a reliable fluid seal when engaged by the frangible valve sealing plate.

According to another valve mounting arrangement, an annular valve seat is formed on one end of a valve sub, and a hinge slot intersects a portion of the valve seat. The hinge block is confined within the slot by a radially projecting annular shoulder disposed within the bore of a valve housing sub. A resilient, elastomeric jacket is fitted about the periphery of a frangible disk closure element The closure disk is provided with a sloping, annular sealing face, and the annular, elastomeric jacket is fitted about the sloping portion of the annular sealing face. A fluid seal is provided by engagement of the elastomeric jacket against the sloping valve seat as the frangible closure plate is moved to the valve closed position.

According to yet another arrangement, an elastomeric hinge block is provided with a flexible shank portion which is attached to the frangible closure element An anchor stub, integrally formed with the shank portion, is mounted onto the valve seat sub. In one embodiment, an annular, beveled valve seat is formed on the valve seat sub and the anchor stub is captured between the valve seat sub and a radially projecting, annular shoulder formed within the bore of a valve housing sub. In another mounting arrangement, the anchor stub is secured to the end face of the valve seat sub by threaded fasteners.

In yet another arrangement, the flexibility of the resilient shank portion of the elastomeric hinge is enhanced by a V notch formed on one side of the shank, with the opposite side of the shank being sliced at longitudinally spaced locations along the shank between the anchor plate and hinge shoulder.

Other objects and advantages of the present invention will be appreciated by those skilled in the art upon reading the detailed description which follows with reference to the attached drawings.

BRIEF DESCRIPTION OF THE DRAWINGS

FIG. 15 is a view similar to FIG. 11 which illustrates yet another embodiment of an elastomeric hinge; and FIG. 16 is a sectional view of the elastomeric hinge shown in FIG. 15, with the hinge being illustrated in its relaxed, valve closed position.

DETAILED DESCRIPTION OF THE PREFERRED EMBODIMENT

Figure 1:
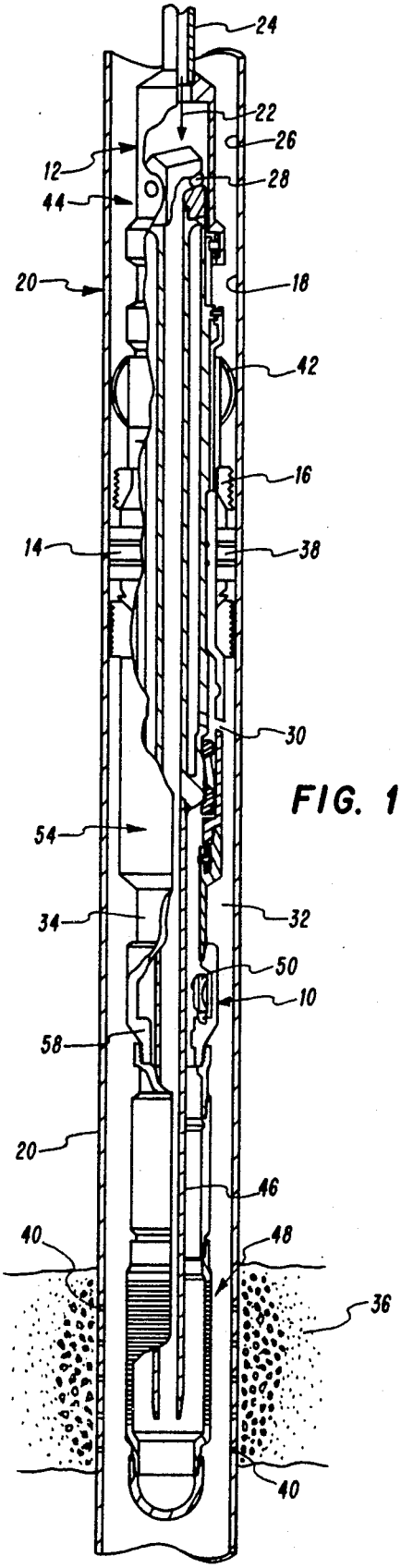
FIG. 1 is a view, partly in section and partly in elevation, showing a typical well installation using a flapper valve assembly constructed according to the present invention.

In the description that follows, like parts are marked throughout the specification and drawings with the same reference numerals, respectively. The drawings are not necessarily to scale and the proportions of certain parts have been exaggerated to better illustrate details of the present invention.

Referring now to FIG. 1, a flapper valve assembly 10 constructed according to the teachings of the present invention is shown in valve open position for accommodating a gravel pack service operation. In this assembly, a cross-over tool (service seal unit) 12 is landed within a packer 14. The packer 14 has hydraulically-actuated slips 16 which set the packer against the bore 18 of a tubular well casing 20. The cross-over tool 12 is coupled to the packer while gravel slurry 22 is pumped through a work string 24 into the bore 26 of the cross-over tool.

The gravel slurry 22 is pumped through lateral flow passages 28 which intersect the side wall of the cross-over tool, and through lateral flow passages 30 which intersect the side wall of the packer 12. The annulus 32 between the casing 20 and the production conduit 34 is sealed above and below a producing formation 36 by expanded seal elements 38 carried on packer 14, and by corresponding seal elements carried on a lower packer below the formation (not shown). The annulus 32 is filled with the slurry 22, and the slurry is pumped through perforations 40 formed in the well casing 20. The landed position of the crossover tool 12 is carefully set within the packer 14 with the aid of centralizer fins 42.

After a well treatment procedure has been completed, the bore 28 of the cross-over tool is pressurized with clean-out fluid to remove excess slurry and to clean the work string bore. This is carried out with the sealing surfaces of the cross-over tool engaged within the polish bore of the packer 14, and with the lateral flow passages of the cross-over tool positioned to admit flow of clean-out fluid. The clean-out fluid is circulate downwardly through the annulus intermediate the well casing and the work string, with the clean-out fluid moving in reverse flow direction upwardly through the bore of the cross-over tool and through the work string 24.

After the gravel packing or other treatment is finished, completion fluids are introduced into the upper annulus to displace the service fluids used during well treatment. After the completion fluid has been introduced, the cross-over tool 12 and the wash pipe 46 are removed from the well.

Completion fluid and particulates in the casing annulus 44 above the packer 14 can flow into the bore of the liner and penetrate the formation 36. It is desirable to circulate the particulates and the completion fluid to the surface to prevent damage to the screen 48 and to avoid squeezing or otherwise disturbing the established position of the gravel pack. A commonly used completion fluid is aqueous calcium chloride, having a weight of approximately 11.5 pounds per gallon. It will be appreciated that a column of such completion fluid if unrestrained will penetrate the formation 36 and possibly disturb the established gravel pack. The volume of the annulus 44 between the production tubing and the well casing may be as much as 8 to 10 times greater than the volume of the production tubing, so that a considerable amount of valuable completion fluid will be lost if permitted to penetrate into the surrounding formation, and because of its strong pressure, may interfere with formation treatments such as acidizing deposits and gravel packs.

Figure 2:
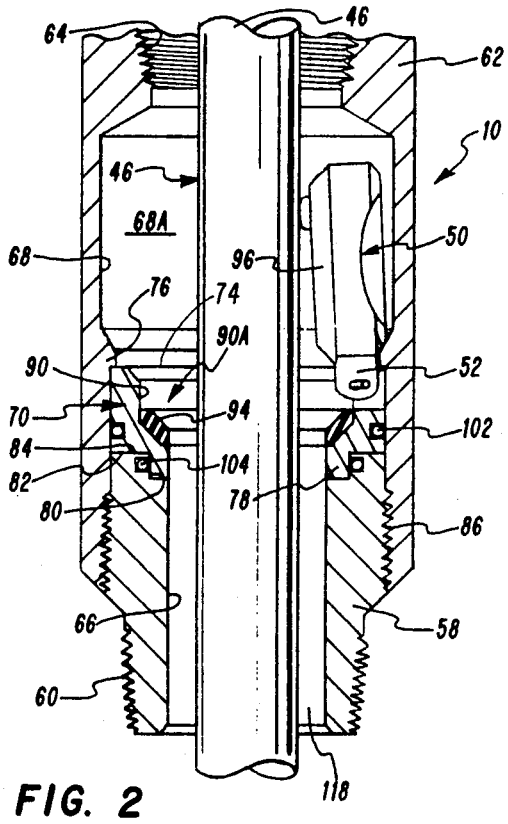
FIG. 2 is a sectional view of the flapper valve assembly shown in FIG. 1, with the flapper closure member being held in valve open position by a length of wash pipe.
Figure 3:
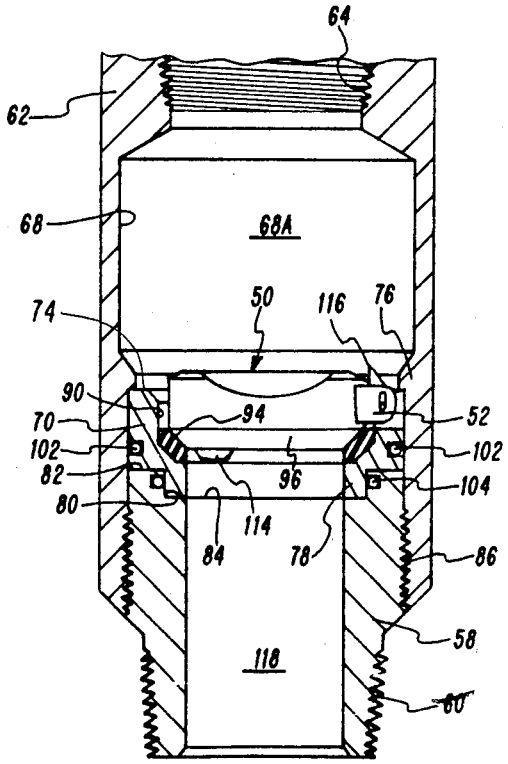
FIG. 3 is a view similar to FIG. 2 with the wash pipe removed and the flapper valve in closed position.

During the course of the well treatment operation, the flapper valve 10 is held in open position as shown in FIGS. 1 and 2 by the wash pipe 46. Upon withdrawal of the wash pipe, the valve closure element 50 moves automatically to the closed and sealed position as shown in FIG. 3, thereby containing the completion fluid and preventing it from release into the formation 36. With the flapper valve 10 thus protecting the formation 36, the clean-up operations, for example, cleaning up the well bore, can be carried out and the completion fluid can be recovered with the wash pipe 46 disengaged. After the completion fluid has been recovered, the work string is then retrieved from the well and a production tubing string is run into the well in its place. Such operations may take several days, during which time the formation 36 is protected by the closed flapper valve 10.

Upon completion of clean-up operations and recovery of the completion fluid, the production string is inserted into the well and is coupled to the upper packer 14 to provide for production from the formation 36 to the surface. Before the onset of production operations, however, the flapper valve 10 must be reopened to permit formation fluids to be lifted to the surface.

In one class of flapper valves, an actuator attached to the valve is engaged by a tool such as a tail pipe or a wire line tool to move the valve closure member 50 to the valve open position. In another class of flapper valve construction, the valve closure member 50 is constructed so that it will be ruptured or otherwise destroyed in response to a mechanical or hydraulic opening force The flapper valve closure member 50 is preferably constructed of a frangible material such as tempered glass which will rupture under an opening force to provide a fully opened bore through the production string. In some cases, the production string is provided with a tail pipe tool which effects destruction or opening of the frangible valve member. In other cases, the frangible valve member is designed to rupture under the build-up of hydraulic pressure or in response to a downward penetrating force exerted by a wire line tool or a drop bar.

The passage through the flapper valve may be obstructed, in some cases, by failure of the frangible closure member to thoroughly fracture into pieces small enough to be circulated to the surface. Metal hinge structures in some cases obstruct the flow passage and may cause scarring or other physical damage to downhole equipment.

According to the teachings of the present invention, the flapper valve closure member 50 is constructed of a tempered glass rather than ceramic or metal, which will reliably shatter into relatively small pieces which can be removed from the tubing by reverse flow of completion fluid. Moreover, the frangible valve closure member 50 is supported by an elastomeric hinge 52 which is severed or otherwise cleanly separated from the valve closure element to provide clear passage through the valve in response to a rupturing force imparted by hydraulic or mechanical means directed onto the frangible sealing member.

The hinge assembly 52 is constructed of an elastomeric material, for example an elastomer material strengthened in a Nitrile treatment for service to 275 degrees F, or by Flourel for service to 400 degrees F, for example. Such material is durable and capable of reliable operation under downhole conditions, but can be easily stripped or sheared apart in response to a rupturing force applied to the frangible valve closure element. The elastomeric hinge 52 is secure directly to the body of the glass closure element 50 in a molecular bond which is produced during compression molding of the elastomeric hinge directly onto the body of the glass closure element 50.

Referring now to FIGS. 2, 3, 4, 5 and 6, the flapper valve assembly 10 is interposed between the upper packer 14 and the screen 48, and is mechanically attached by threaded connections at its upper end to the seal bore sub 54, and at its lower end to a lower extension sub 56. The flapper valve assembly 10 includes a valve seat sub 58 having male thread 60 for engaging the lower extension sub 56. A valve housing sub 62 engages the valve seat sub 58 in threaded connection, and is provided with female threads 64 for making a threaded union with the extension sub 34.

The valve seat sub 58 is provided with a fluid passage bore 66, and the valve housing sub 62 is provided with an enlarged bore 68 which defines a valve chamber 68A to accommodate movement of the flapper valve closure member 50 from the valve open position as shown in FIG. 2, to the valve close position as shown in FIG. 3.

Figure 5:
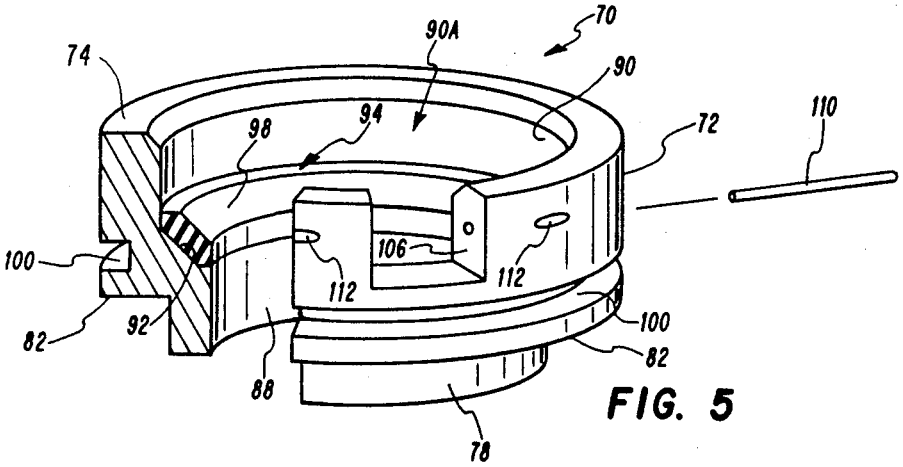
FIG. 5 is a perspective view, partly in section, of the valve seat shown in FIGS. 2 and 3.

According to an important feature of the invention, the valve closure member 50 and hinge 52 are moveably coupled to a valve seat 70 which is axially confined between the valve seat sub 58 and the valve housing sub 68. Referring now to FIG. 5, the valve seat is an annular member having a cylindrical side wall 72 which is concentrically received within the valve housing sub, and is provided with an annular compression face 74 which is engaged by a radially projecting shoulder 76 which is disposed within the bore of the valve housing sub 62. The valve seat is provided with a reduced diameter lower side wall 78 which is received within a cylindrical counterbore pocket 80 which is formed in the valve seat sub 58. A lower compression face 82 is formed on the valve seat, which is engaged by an annular face 84 formed on the upper terminal end of the valve seat sub 58. According to this arrangement, the valve seat 70 is axially compressed between the valve housing sub 62 and the valve seat sub 58 as the threaded union 86 is made up.

Referring now to FIG. 5, the valve seat is provided with a fluid passage bore 88 and an enlarged counter bore 90 which defines a valve pocket 90A. The side wall 72 transitions along an annular sloping face 92 which supports a resilient, annular seal 94, preferably constructed of an elastomeric material. As can best be seen in FIGS. 2 and 3, the valve closure member 50 has an annular, beveled side wall 96 which is dimensioned for surface-to-surface engagement with the face 98 of the annular seal 94.

Figure 4:
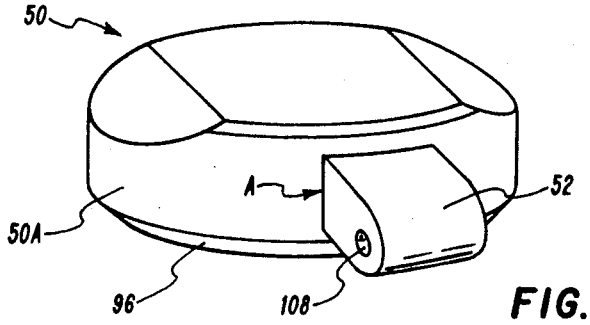
FIG. 4 is a perspective view of a flapper valve closure disk and elastomeric hinge combination.
Figure 6:
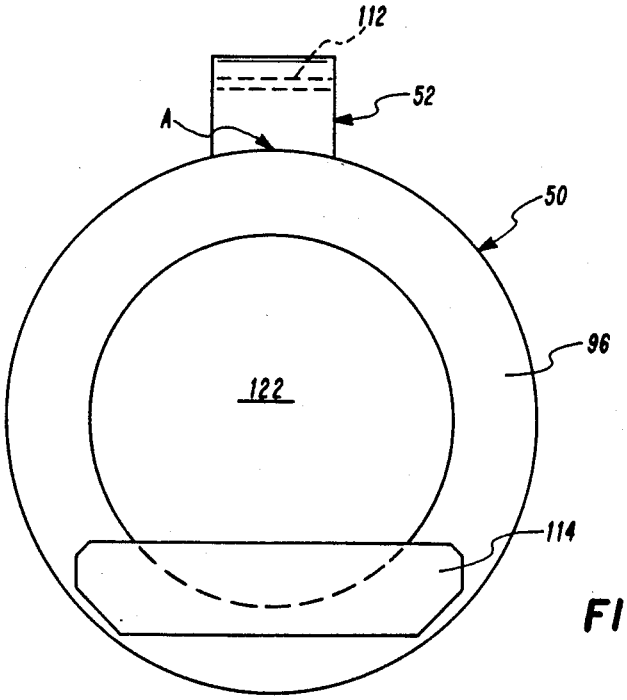
FIG. 6 is a bottom plan view of the flapper valve closure element shown in FIG. 4.

Referring now to FIGS. 4, 5 and 6, the valve seat 70 is provided with an annular slot 100 in which an elastomeric seal 102 is received for producing a fluid seal against the inside bore of the valve housing sub as shown in FIGS. 2 and 3. The valve seat is likewise sealed against the valve seat sub by an elastomeric seal 104 as shown in FIGS. 2 and 3.

According to an important feature of the preferred embodiment, the elastomeric hinge 52 is received within a hinge slot 106 formed within the cylindrical seat side wall 72. According to this arrangement, the elastomeric hinge is provided with a bore 108 through which a hinge pin 110 extends. The hinge pin is inserted through a bore 112 which intersects the cylindrical side wall 72 as shown in FIG. 5. By this arrangement, the valve closure member 50 is supported by the elastomeric hinge 52, which rides upon and pivots about the hinge pin 110 as the valve closure member 50 rotates into engagement with the annular seal 94 in the valve closed position as shown in FIG. 3, to the valve open position as shown in FIG. 2.

The valve closure member 50 is preferably a frangible disk or plate of tempered glass, for example, a borosilicate glass having strength sufficient to withstand the required pressures, and which will shatter into small pieces when impacted. According to the preferred embodiment of the invention, the elastomeric hinge 52 is joined directly to the cylindrical side wall 50A of the glass disk in a process in which the molecular bond is produced at the interface A between the elastomeric hinge and the glass during molding. Additionally, a bumper pad 114 of an elastomeric material is bonded to the underside of the glass closure disk. The purpose of the bumper pad 114 is to engage and ride against the wash pipe 46 as shown in FIG. 2.

The flapper valve assembly 10 as illustrated in FIGS. 2–6 provides a reliable fluid seal in the valve closed position as shown in FIG. 3. According to this valve construction, the valve closure element and the associated hinge are maintained substantially out of the fluid flow passage in the valve open, retracted position shown in FIG. 2, by engagement with the wash pipe 46. It is desirable that the valve closure member 50 move automatically to the closed position as shown in FIG. 3 upon withdrawal of the wash pipe. According to a preferred feature of the invention, the elastomeric hinge 52 is provided with a resilient stub member 116 which is flexed against the shoulder 76 of the valve housing sub in the valve open position as shown in FIG. 2. The spring force exerted by the resilient stub 116 provides an initial bias action which tends to rotate the valve closure member 50 in the counterclockwise direction upon removal of the wash pipe 46. The hydraulic pressure differential across the inclined valve closure member 50 causes the complete, rapid movement of the valve closure member to the closed position as shown in FIG. 3.

It will be appreciated that the glass closure member 50 when impacted by a tail pipe tool or drop bar will shatter thoroughly into relatively small pieces. Additionally, a fracturing impact force will tend to cause the glass disk to cleanly separate from the elastomeric hinge 52. It will be observed in FIG. 3 that the elastomeric hinge, because of its construction and mounting arrangement, does not project into the fluid flow passage 118. Moreover, any residual fragments of the glass disk which remain joined to the elastomeric hinge will be easily broken away and will not interfere with subsequent operation of downhole equipment.

Figure 7:
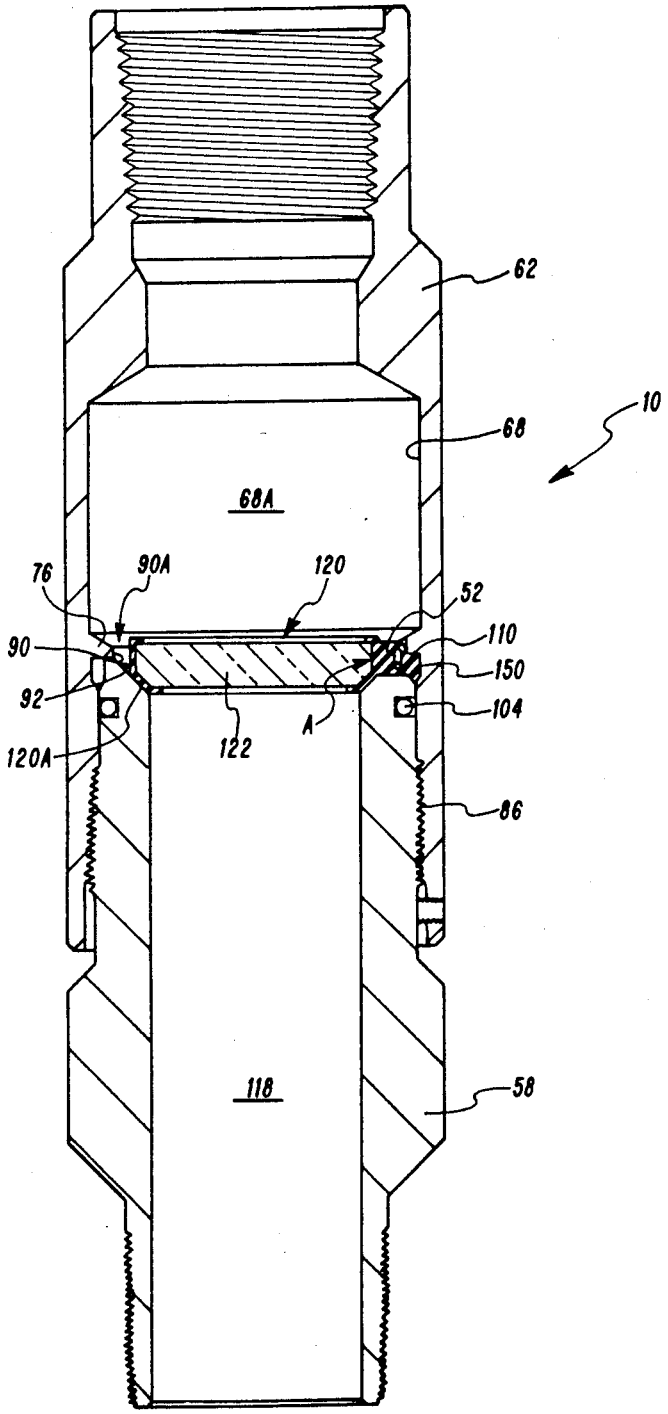
FIG. 7 is a longitudinal sectional view of a flapper valve assembly constructed according to an alternate embodiment in which a frangible valve closure member is supported by an elastomeric jacket and hinge assembly.
Figure 8:
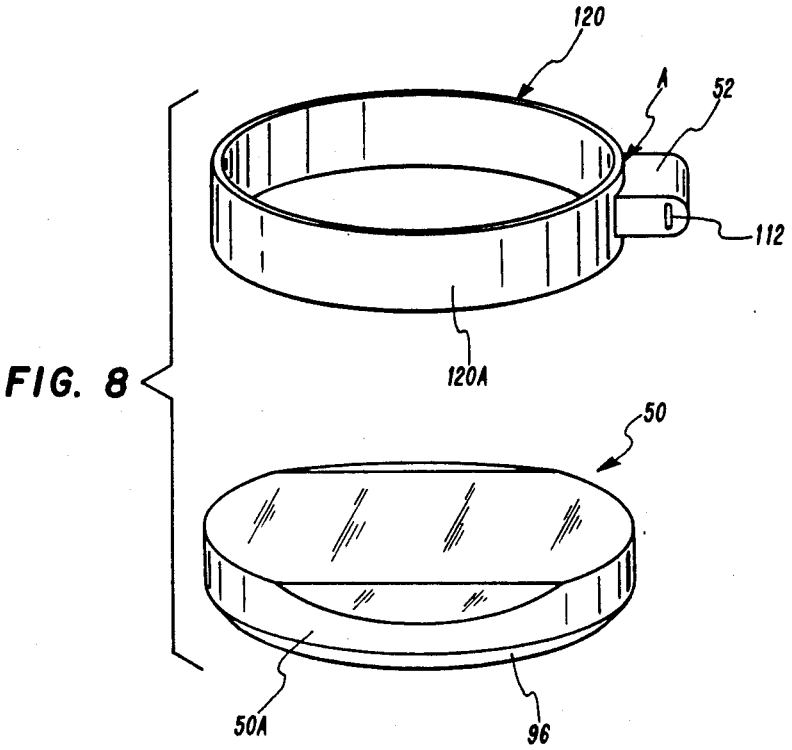
FIG. 8 is an exploded view of the frangible valve closure member and elastomeric jacket shown in FIG. 7.
Figure 9:
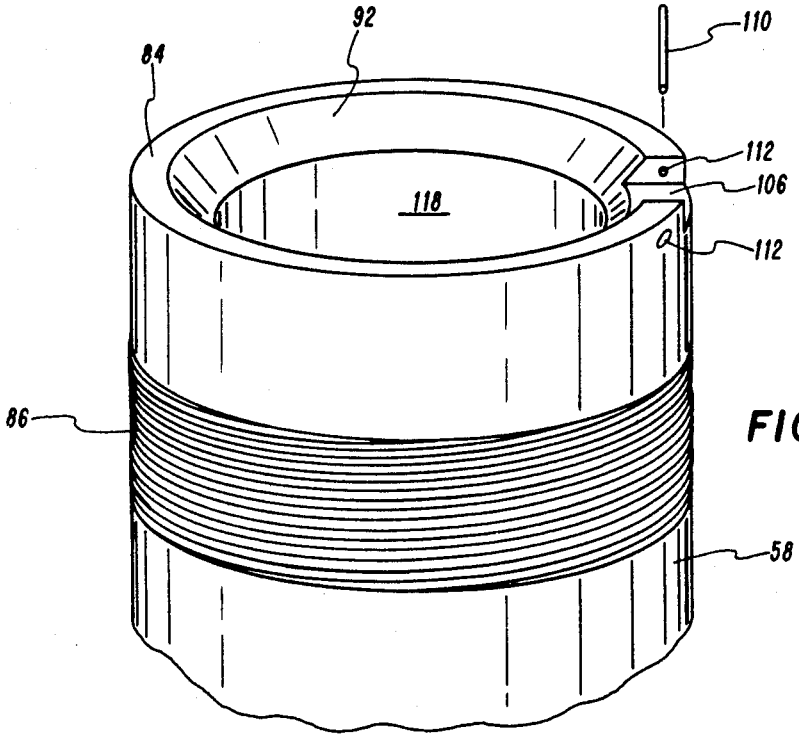
FIG. 9 is a perspective view of the valve seat structure shown in FIG. 7.

Referring now to FIGS. 7, 8 and 9, alternative embodiments for the elastomeric hinge assembly and mounting structure are disclosed. In particular, the separate valve seat component 70 is eliminated, with the sloping annular face 92 formed on the end of the valve seat sub 58, with the valve pocket 90 (FIG. 7) being formed by the enlarged counter bore which is produced when the sloping annular face 92 is formed. According to this arrangement, the hinge slot 106 intersects the side wall of the valve seat sub 58 and partially intersects the sloping annular valve seat 92 as best can be seen in FIG. 9. The hinge block 52 is received within the slot 106 and rides upon a hinge pin 110 as previously discussed. In this arrangement, the hinge block 52 is confined axially by the annular shoulder 76 carried on the valve housing sub 62.

Mechanical support for the frangible closure member 50, and also a resilient seal is provided by an elastomeric jacket 120 as shown in FIGS. 7 and 8. According to this arrangement, a band 120 of elastomeric material is integrally molded with the hinge block 52 and is joined onto the cylindrical side wall 50A of the glass closure disk 50 by a molecular bond along the interface region A. As can best be seen in FIGS. 7 and 8 the elastomeric jacket 120 is fitted about the cylindrical side wall 50A of the glass disk, and also around the beveled sealing face 96 of the glass disk. That is, an annular portion 120A is wrapped about the cylindrical side wall portion 50A, the beveled annular face 96 and the bottom plate portion 122. The elastomeric jacket portion 120A produces a fluid seal when engaged against the sloping annular valve seat 92 as shown in FIG. 7. In this alternative embodiment, the separate annular elastomeric seal element 94 is eliminated, and the separate valve seat body structure 70 is also eliminated. The flapper valve assembly 10 operates otherwise in the same manner as previously discussed in connection with the first preferred embodiment.

Figures 10, 10A:
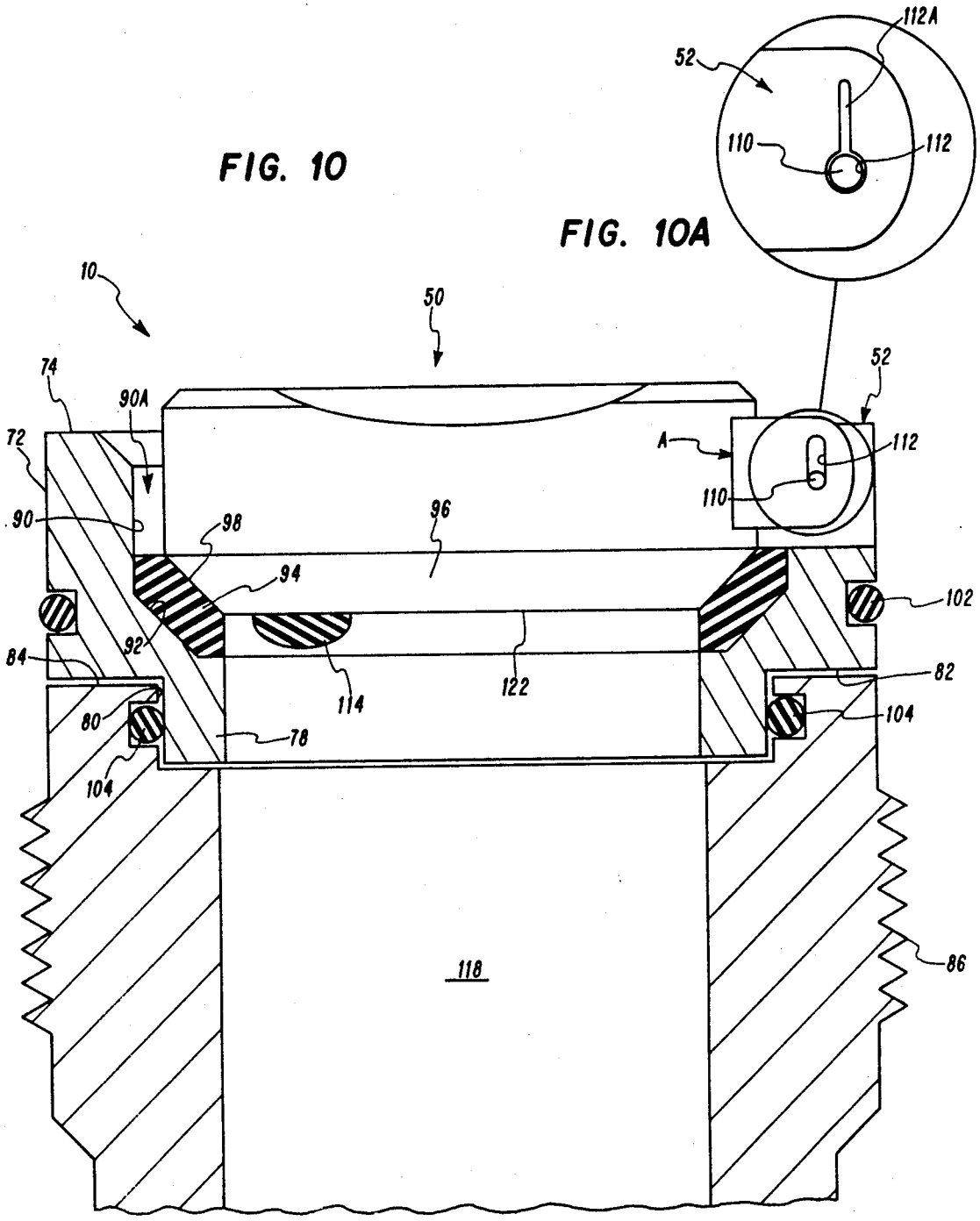
FIG. 10 is a sectional view, partially broken away, similar to FIG. 3, which illustrates an alternate hinge construction.
FIG. 10A is an elevational view, partially broken away, of an alternate hinge construction.

Referring now to FIGS. 10 and 10A, the hinge assembly 52 is provided with an elongated slot 112 which permits the leverage point to shift slightly as the glass closure member 50 rotates from the fully open position as shown in FIG. 2 to the fully closed position as shown in FIGS. 3 and 10. That is, the position of the pin 110 remains fixed, while the position of the hinge 52 rotates about the pin and translates radially with respect thereto. In the arrangement shown in FIG. 10A, the slot comprises a cylindrical passage 112 which opens into a narrow slot 112A. The narrow slot 112A is dimensioned to accommodate expansion of the hinge 52 in response to elevated downhole temperatures, to maintain a close fit about the hinge pin 110, and maintain correct alignment of the closure plate 50 within the valve pocket 90A.

Figure 11:
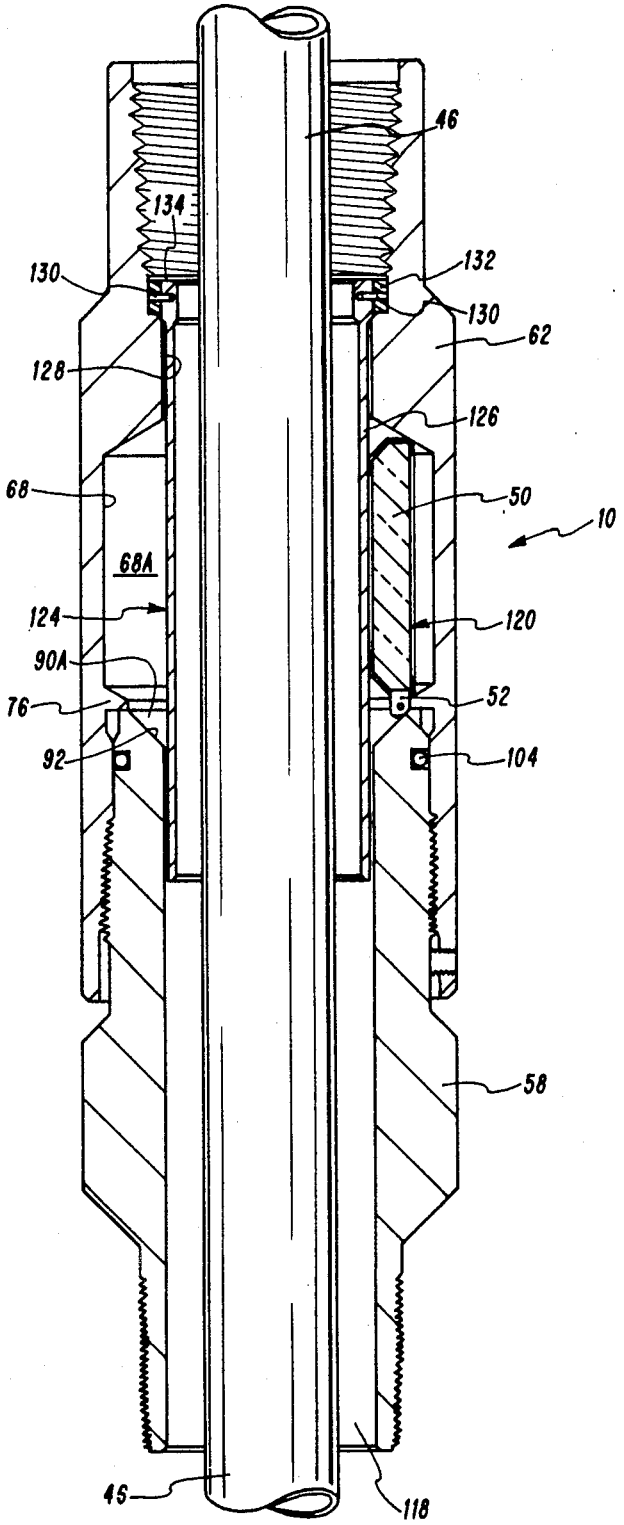
FIG. 11 is a view similar to FIG. 2 which includes a prop sleeve for holding the frangible closure disk in valve open position.

Referring now to FIG. 11, the flapper valve closure disk 50 is held in valve open position by a prop sleeve 124. The prop sleeve 124 has a thin cylindrical side wall 126 which is concentrically received in sliding engagement against the smaller fluid passage bore 128 of the valve housing sub 62. Preferably, the prop sleeve 124 is secured by shear pins 130 which anchor the prop sleeve onto a collar ring 132 which is fitted inside the threaded box of the valve housing sub. According to this arrangement, the flapper valve 50 is held open during the initial run-in installation to permit unrestricted passage of the wash pipe and other downhole tools. The flapper valve is subsequently released by applying a shearing force against the lower annular face 134 of the prop sleeve 124. The shear pin arrangement is shown in better detail in FIG. 12.

Figure 12:
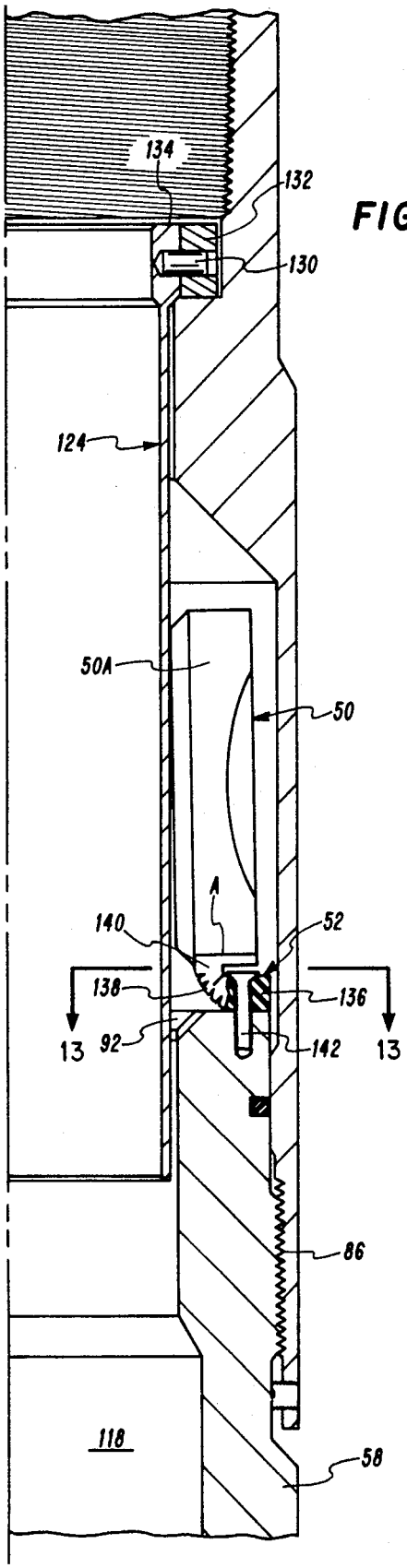
FIG. 12 is a view similar to FIG. 11 which illustrates an alternate embodiment of an elastomeric hinge.
Figure 13:
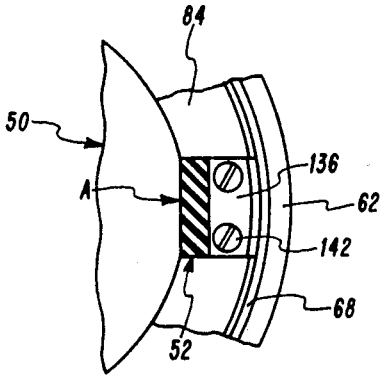
FIG. 13 is a sectional view, partly broken away, taken along the lines 13—13 of FIG. 12.
Figure 14:
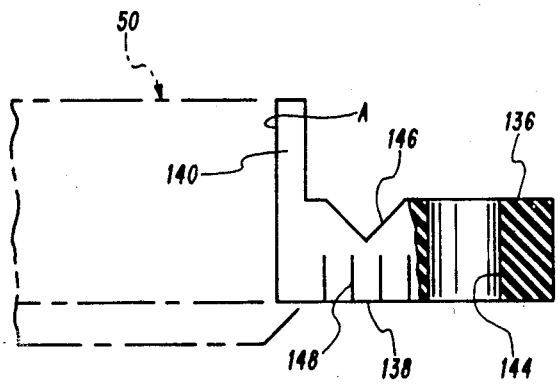
FIG. 14 is a side elevation view of the elastomeric hinge of FIG. 13, shown in its relaxed, valve closed position.

Referring now to FIGS. 12, 13 and 14, an alternate construction of the hinge 52 is illustrated. In this arrangement, the hinge 52 comprises an anchor plate portion 136, a flexible shank and an upright shoulder portion 140. According to this arrangement, the hinge assembly 52 is secured to the annular face 84 of the valve seat sub 58 by a pair of threaded fasteners 142. In this arrangement, the anchor plate is provided with a cylindrical bore 144 and the valve seat sub 58 is provided with a tapped bore which receives the threaded fastener 142. The hinge shoulder 140 is bonded directly to the cylindrical side wall 50A of the glass closure disk 50.

The flexibility of the resilient shank portion 138 is enhanced by a V notch 146 formed on one side of the shank, with the opposite side of the shank having longitudinally spaced slices 148 along the shank between the anchor plate 136 and hinge shoulder 140. This permits the hinge to flex correctly to provide greater flexibility, and at the same time, reduces stresses in the elastomeric hinge material.

An alternate embodiment of the hinge 52 is illustrated in FIGS. 15 and 16. In this arrangement, the glass closure disk 50 is partially encapsulated by the elastomeric jacket 120, and is integrally formed with an elastomeric hinge 52 having a shank 138 and an anchor stub 150. The anchor stub is captured in the annular recess 152 formed between the lower and upper subs 58, 62. In this arrangement, the anchor stub is compressed between the annular face 84 formed on the valve seat sub 58, and the annular shoulder 76 formed on the valve housing sub 62. The upper end of the lower sub does not shoulder up as illustrated in FIG. 7, and instead, the lower end of the upper sub abutts the upwardly facing external annular shoulder of the lower sub 58 below the threaded union 86.

It will be appreciated that each of the foregoing embodiments provide a frangible flapper valve assembly which produces a reliable fluid seal when in closed position, to permit completion fluid to be recovered, and which controls the effect of the completion fluid pressure on the surrounding formation. Moreover, the frangible, glass sealing element will shatter into relatively small pieces in response to a mechanical or hydraulic opening force. The elastomeric hinge structure is mounted out of the fluid flow passage and does not interfere with operation of downhole equipment.

Although the invention has been described with reference to specific embodiments, and with reference to a specific gravel pack operation, the foregoing description is not intended to be construed in a limiting sense. Various modifications of the disclosed embodiments as well as alternative applications of the invention will be suggested to persons skilled in the art by the foregoing specification and illustrations. It is therefore contemplated that the appended claims will cover any such modifications, applications or embodiments as fall within the true scope of the invention.

What is claimed is:

1. A flapper valve assembly comprising, in combination:

valve seat body means having a flow passage therethrough;

a tubular valve housing sub coupled to said valve seat body means, said valve housing sub having a flow passage communicating with the flow passage of said valve seat body means and having a valve chamber opening into said flow passage;

a frangible valve closure plate rotatable from a valve open position in which said closure plate is disposed within said valve chamber to a valve closed position in which said closure plate extends transversely across said flow passage for preventing flow through flow passage when said closure plate is engaged against said valve seat body means in the valve closed position;

a hinge of elastomeric material secured to said closure plate and coupling said closure plate to said valve seat body means;

said elastomeric hinge having an anchor portion mounted on said valve seat body means, a shoulder portion attached to said valve closure plate, and a flexible shank portion connecting said shoulder plate to said anchor portion; and, said closure plate having a sidewall and said hinge including an elastomeric band secured around said sidewall.

2. A flapper valve assembly as defined in claim 1, wherein said shank portion of said hinge having first and second opposite side surfaces and a V notch partially intersecting said shank portion through one side surfaced thereof, and having a plurality of slice perforations partially intersecting said shank portion through the opposite side surface thereof at spaced locations between said anchor plate portion and said shoulder portion.

3. A flapper valve assembly as defined in claim 1, including a tubular valve housing sub having a bore defining a fluid flow passage and mateable with the valve seat body, said anchor portion comprising an anchor stub confined between said valve seat body and said valve housing sub, and said shank portion being attached to said anchor stub, said shank portion being bonded directly to said valve closure plate.

4. A flapper valve assembly as defined in claim 1, wherein said valve closure plate comprises glass and said elastomeric hinge is secured by a molecular bond produced at the interface between said shoulder portion and the glass closure plate during a molding process.

5. A gravel packing apparatus for treating a formation surrounding a perforated zone of a subterranean well casing comprising, in combination:

a packer including a mandrel, anchoring and sealing means for securing said packer on said well casing and sealing therebetween; a tubular liner assembly attached to and depending from the packer mandrel and communicating with an outer tubular string, said outer tubular string being sealingly engaged with the packer mandrel, said liner assembly including a lower perforated portion through which fluid can flow from the annulus between the well casing and into the interior of the liner assembly and an upper ported portion through which fluid can flow between the well casing and the interior of the upper liner assembly, cross-over means disposed within said packer and liner assembly and coupled in communication with an inner tubular member extending through the outer tubular string to the top of the well, said cross-over means being adapted to prevent flow of fluid between the lower perforated portion and the annulus between the inner tubular member and the outer tubular string, and to selectively form separate fluid passages between the inner tubular member and the upper ported portion, a flapper valve assembly interposed in said liner in series fluid communication between said screen and said packer, said flapper valve assembly including a valve seat assembly having a bore therethrough, a valve chamber disposed about and opening into said bore, and a frangible valve closure plate rotatable about pivot means carried by said valve seat assembly within said valve chamber for preventing flow through said bore when said closure plate is engaged against said valve seat assembly, and a hinge of elastomeric material secured to said closure plate and coupling said closure plate to said pivot means, said elastomeric hinge including an anchor portion mounted on said valve seat assembly, a shoulder portion attached to said valve closure plate, and a flexible shank portion connecting said shoulder portion to said anchor portion, said shank portion including first and second side surfaces and a V notch partially intersecting said shank portion through the first side surface thereof, and having a plurality of slice perforations partially intersecting said shank portion at spaced locations through the second side surface thereof.

6. A flapper valve assembly comprising, in combination:

a tubular valve seat sub having a bore defining a fluid flow passage, said valve seat sub having an annular face and an annular seating surface disposed about said flow passage;

a tubular valve housing sub having a bore defining a fluid flow passage and a counterbore disposed about said flow passage defining a valve chamber, said valve housing sub being mateable with said tubular valve seat sub, said housing sub having an annular shoulder projecting into valve chamber;

pivot means attached to said valve seat sub;

a frangible valve closure plate mounted for rotation about said pivot means, said closure plate having an annular sealing surface for preventing flow through said flow passage when said closure plate sealing is engaged against said annular seating surface;

a hinge secured to said closure plate and coupling said closure plate to said pivot means, said hinge comprising a block of elastomeric material having an elastomeric jacket portion secured to said closure plate, said elastomeric jacket portion covering said closure plate sealing surface, said elastomeric jacket portion producing a fluid seal when compressed between said closure plate and said annular valve seat; and, said tubular valve seat sub having a cylindrical sidewall and a hinge slot formed in said cylindrical sidewall, said hinge being received within said hinge slot, and said pivot means including a hinge pin received within said hinge slot and coupling said hinge to said cylindrical sidewall.

7. A flapper valve assembly as defined in claim 6 wherein said hinge includes an anchor stub received in compression engagement between the annular face of said tubular, valve seat sub and the annular shoulder carried by said tubular valve housing sub.

8. A gravel packing apparatus for treating a formation surrounding a perforated zone of a subterranean well casing comprising, in combination:

a packer including a mandrel, anchoring and sealing means for securing said packer on said well casing and sealing therebetween; a tubular liner assembly attached to and depending from the packer mandrel and communicating with an outer tubular string, said outer tubular string being sealingly engaged with the packer mandrel, said liner assembly including a lower perforated portion through which fluid can flow from the annulus between the well casing and into the interior of the liner assembly and an upper ported portion through which fluid can flow between the well casing and the interior of the upper liner assembly; cross-over means disposed within said packer and liner assembly and coupled in communication with an inner tubular member extending through the outer tubular string to the top of the well, said cross-over means being adapted to prevent flow of fluid between the lower perforated portion and the annulus between the inner tubular member and the outer tubular string, and to selectively form separate fluid passages between the inner tubular member and the upper ported portion; a flapper valve assembly interposed in said liner in series fluid communication between said screen and said packer, said flapper valve assembly including a valve seat assembly having a bore therethrough and a frangible valve closure plate rotatable about pivot means carried by said valve seat assembly for preventing flow through said bore when said closure plate is engaged against said valve seat assembly, and a hinge of elastomeric material secured to said closure plate and coupling said closure plate to said pivot means, said elastomeric hinge including an anchor portion mounted on said valve seat assembly, a shoulder portion attached to said valve closure plate, and a flexible shank portion connecting said shoulder portion to said anchor portion, and wherein said anchor portion including an elastomeric stub, said stub being compressed between said closure plate and said valve seat assembly when said closure plate is in an open passage position.

9. A flapper valve assembly comprising, in combination:

valve seat body means having a flow passage therethrough;

a tubular valve housing sub coupled to said valve seat body means, said valve housing sub having a flow passage communicating with the flow passage of said valve seat body means and having a valve chamber disposed about and opening into said flow passage;

a frangible valve closure plate rotatable from a valve open position in which said closure plate is retracted within said valve chamber to a valve closed position in which said closure plate is extended transversely across said flow passage into engagement with said valve seat body means for preventing flow through said flow passage;

a hinge of elastomeric material secured to said closure plate and coupling said closure plate to said valve seat body means;

said elastomeric hinge having an anchor portion mounted on said valve seat body means and a flexible shank portion; and, said anchor portion having an anchor stub confined between said valve seat body means and said valve housing sub, and said shank portion being attached to said anchor stub and being bonded directly to said valve closure plate.

10. A flapper valve assembly comprising, in combination.

a tubular valve seat sub having a bore defining a fluid flow passage;

a tubular valve housing sub having a bore defining a fluid flow passage and a counterbore disposed about said flow passage defining a valve chamber, said valve housing sub being mateable with said tubular valve seat sub, said valve housing sub having an annular shoulder projecting into said valve chamber;

a valve body member having a first tubular sidewall portion coupled to said tubular valve housing sub and having a second tubular sidewall portion coupled to said valve seat sub, said valve body member having a first annular face engaged by the annular shoulder of said valve housing sub and having a second annular face engaged and confined by said seat sub;

said valve body member having an annular seating surface disposed about said flow passage;

pivot means mounted on said valve body member;

a frangible valve closure plate rotatable about said pivot means for preventing flow through said flow passage when said closure plate is engaged against said annular seating surface;

a hinge secured to said closure plate and coupling said closure plate to said pivot means;

said closure plate being formed of tempered glass and having a surface for producing a fluid seal when engaged against said annular seating surface; and, said hinge being formed of elastomeric material and being secured to said glass closure plate by a molecular bond at the interface between the hinge and the glass plate produce during a molding process.

11. A flapper valve assembly comprising, in combination:

a tubular valve seat sub having a bore defining a fluid flow passage;

a tubular valve housing sub having a bore defining a fluid flow passage and a counterbore disposed about said flow passage defining a valve chamber, said valve housing sub being mateable with said tubular valve seat sub, said valve housing sub having an annular shoulder projecting into said valve chamber;

a valve body member having a first tubular sidewall portion coupled to said tubular valve housing sub and having a second tubular sidewall portion coupled to said valve seat sub, said valve body member having a first annular face engaged by the annular shoulder of said valve housing sub and having a second annular face engaged and confined by said valve seat sub;

said valve body member having an annular seating surface disposed about said flow passage;

pivot means mounted on said valve body member;

a frangible valve closure plate rotatable about said pivot means preventing flow through said flow passage when said closure plate is engaged against said annular seating surface;

a hinge secured to said closure plate and coupling said closure plate to said pivot means; and, said closure plate having an annular sealing surface, and wherein said hinge comprises a block of elastomeric material having an elastomeric jacket portion secured to said closure plate, said elastomeric jacket portion covering said closure plate sealing surface, and said elastomeric jacket portion producing a fluid seal when compressed between said closure plate sealing surface and said valve body member seating surface.

* * * * *

UNITED STATES PATENT AND TRADEMARK OFFICE

CERTIFICATE OF CORRECTION

PATENT NO. : 4,813,481

DATED : 03/21/89

INVENTOR(S) : Richard M. Sproul, et al.

It is certified that error appears in the above-identified patent and that said Letters Patent is hereby corrected as shown below:

Column 3, line 46, "element The" should be -- element. The --.

Column 3, line 56, "ment An" should be -- ment. An --.

Column 5, line 28, "circulate" should be -- circulated --.

Column 6, line 23, "force The" should be -- force. The --.

Column 10, line 53, "through flow" should be -- through said flow --.

Column 14, line 5, "seat sub" should be -- valve seat sub --.

Column 14, line 21, "produce" should be -- produced --.

Signed and Sealed this

Thirty-first Day of October, 1989

*Attest:*

DONALD J. QUIGG

*Attesting Officer*

*Commissioner of Patents and Trademarks*